US008858872B2

(12) United States Patent
Bergstrom et al.

(10) Patent No.: US 8,858,872 B2
(45) **Date of Patent: *Oct. 14, 2014**

(54) LEAN AUSTENITIC STAINLESS STEEL

(71) Applicant: ATI Properties, Inc., Albany, OR (US)

(72) Inventors: David S. Bergstrom, Allison Park, PA (US); James M. Rakowski, Allison Park, PA (US); Charles P Stinner, Gibsonia, PA (US); John J. Dunn, Sarver, PA (US); John F. Grubb, Lower Burrell, PA (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/651,512

(22) Filed: Oct. 15, 2012

(65) Prior Publication Data

US 2013/0092293 A1 Apr. 18, 2013

Related U.S. Application Data

(63) Continuation of application No. 12/037,477, filed on Feb. 26, 2008, now Pat. No. 8,313,691.

(60) Provisional application No. 60/991,016, filed on Nov. 29, 2007.

(51) Int. Cl.

| | |
|---|---|
| ***C22C 38/44*** | (2006.01) |
| ***C22C 38/58*** | (2006.01) |
| ***C22C 38/52*** | (2006.01) |
| ***C22C 38/38*** | (2006.01) |
| ***C22C 38/42*** | (2006.01) |
| ***C22C 38/34*** | (2006.01) |
| ***C22C 38/22*** | (2006.01) |
| ***C22C 38/32*** | (2006.01) |
| ***C22C 38/30*** | (2006.01) |

(52) U.S. Cl.

CPC ..... *C22C 38/38* (2013.01); *C22C 38/42* (2013.01); *C22C 38/34* (2013.01); *C22C 38/22* (2013.01); *C22C 38/32* (2013.01); *C22C 38/58* (2013.01); *C22C 38/30* (2013.01); *C22C 38/44* (2013.01)

USPC ..... 420/57; 420/38; 420/59; 420/65; 420/66; 420/67; 420/73; 420/74; 148/325; 148/327; 148/337

(58) Field of Classification Search

USPC ..... 148/325, 327, 337; 420/38, 57, 59, 65, 420/66, 67, 73, 74

See application file for complete search history.

(56) References Cited

U.S. PATENT DOCUMENTS

| | | | |
|---|---|---|---|
| 3,171,738 | A | 3/1965 | Renshaw et al. |
| 3,592,634 | A | 7/1971 | Denhard, Jr. et al. |

(Continued)

FOREIGN PATENT DOCUMENTS

| | | | |
|---|---|---|---|
| CA | 2674091 | A1 | 7/2008 |
| EP | 0151487 | A2 | 8/1985 |

(Continued)

OTHER PUBLICATIONS

"Stainless Steels Chromium—Nickel—Molybdenum Types 316 (S31600), 316L (S31603), 317 (S31700), 317L (S31703)", ATI Allegheny Ludlum Allegheny Technologies, Technical Data Blue Sheet, 2006, pp. 1-13.

(Continued)

*Primary Examiner* — Deborah Yee

(74) *Attorney, Agent, or Firm* — K & L Gates LLP; John E. Grosselin, III

(57) ABSTRACT

An austenitic stainless steel having low nickel and molybdenum and exhibiting comparable corrosion resistance and formability properties to higher nickel and molybdenum alloys comprises, in weight %, up to 0.20 C, 2.0-9.0 Mn, up to 2.0 Si, 16.0-23.0 Cr, 1.0-5.0 Ni, up to 3.0 Mo, up to 3.0 Cu, 0.1-0.35 N, up to 4.0 W, up to 0.01 B, up to 1.0 Co, iron and impurities, the steel having a ferrite number of less than 10 and a $MD_{30}$ value of less than 20° C.

38 Claims, 1 Drawing Sheet

(56) References Cited

U.S. PATENT DOCUMENTS

| | | | | |
|---|---|---|---|---|
| 3,599,320 | A | 8/1971 | Brickner et al. | |
| 3,615,365 | A | 10/1971 | McCunn | |
| 3,645,725 | A | 2/1972 | Denhard, Jr. et al. | |
| 3,650,709 | A | 3/1972 | Morsing | |
| 3,716,691 | A | 2/1973 | Baybrook et al. | |
| 3,736,131 | A * | 5/1973 | Espy | 420/34 |
| 3,770,426 | A | 11/1973 | Kloske et al. | |
| 3,854,938 | A | 12/1974 | Baybrook et al. | |
| RE28,645 | E | 12/1975 | Aoki et al. | |
| 4,099,966 | A | 7/1978 | Chivinsky et al. | |
| 4,170,499 | A | 10/1979 | Thomas et al. | |
| 4,325,994 | A | 4/1982 | Kitashima et al. | |
| 4,340,432 | A | 7/1982 | Hede | |
| 4,609,577 | A | 9/1986 | Long | |
| 4,798,635 | A | 1/1989 | Bernhardsson et al. | |
| 4,814,140 | A | 3/1989 | Magee, Jr. | |
| 4,828,630 | A | 5/1989 | Daniels et al. | |
| 4,985,091 | A | 1/1991 | Culling | |
| 5,047,096 | A | 9/1991 | Eriksson et al. | |
| RE33,753 | E | 11/1991 | Vacchiano et al. | |
| 5,203,932 | A | 4/1993 | Kato et al. | |
| 5,238,508 | A | 8/1993 | Yoshitake et al. | |
| 5,254,184 | A | 10/1993 | Magee, Jr. et al. | |
| 5,259,443 | A | 11/1993 | Osada et al. | |
| 5,286,310 | A | 2/1994 | Carinci et al. | |
| 5,298,093 | A | 3/1994 | Okamoto | |
| 5,340,534 | A | 8/1994 | Magee | |
| 5,496,514 | A | 3/1996 | Yamauchi et al. | |
| 5,514,329 | A | 5/1996 | McCaul et al. | |
| 5,624,504 | A | 4/1997 | Miyakusu et al. | |
| 5,672,215 | A | 9/1997 | Azuma et al. | |
| 5,672,315 | A | 9/1997 | Okato et al. | |
| 5,716,466 | A | 2/1998 | Yamaoka et al. | |
| 5,733,387 | A | 3/1998 | Lee et al. | |
| 5,849,111 | A | 12/1998 | Igarashi et al. | |
| 6,042,782 | A | 3/2000 | Murata et al. | |
| 6,056,917 | A | 5/2000 | Chesseret et al. | |
| 6,096,441 | A | 8/2000 | Hauser et al. | |
| 6,274,084 | B1 | 8/2001 | Haudrechy | |
| 6,395,108 | B2 | 5/2002 | Eberle et al. | |
| 6,551,420 | B1 | 4/2003 | Bergstrom et al. | |
| 6,623,569 | B2 | 9/2003 | Bergstrom et al. | |
| 6,824,672 | B2 * | 11/2004 | Lecour et al. | 208/48 R |
| 6,949,148 | B2 | 9/2005 | Sugiyama et al. | |
| 6,958,099 | B2 | 10/2005 | Nakamura et al. | |
| 7,014,719 | B2 | 3/2006 | Suzuki et al. | |
| 7,014,720 | B2 | 3/2006 | Iseda | |
| 7,070,666 | B2 | 7/2006 | Druschitz et al. | |
| 7,090,731 | B2 | 8/2006 | Kashima et al. | |
| 7,101,446 | B2 | 9/2006 | Takeda et al. | |
| 7,842,434 | B2 | 11/2010 | Rakowski et al. | |
| 7,981,561 | B2 | 7/2011 | Rakowski et al. | |
| 8,313,691 | B2 * | 11/2012 | Bergstrom et al. | 420/57 |
| 8,337,748 | B2 | 12/2012 | Rakowski et al. | |
| 8,337,749 | B2 | 12/2012 | Bergstrom et al. | |
| 2002/0102178 | A1 | 8/2002 | Hiramatsu et al. | |
| 2003/0021716 | A1 | 1/2003 | Hauser et al. | |
| 2003/0086808 | A1 | 5/2003 | Sundstrom et al. | |
| 2003/0099567 | A1 | 5/2003 | Suzuki et al. | |
| 2003/0121567 | A1 | 7/2003 | Sugiyama et al. | |
| 2003/0231976 | A1 | 12/2003 | Iseda | |
| 2005/0103404 | A1 | 5/2005 | Hsieh et al. | |
| 2005/0158201 | A1 | 7/2005 | Park et al. | |
| 2005/0194073 | A1 | 9/2005 | Hamano et al. | |
| 2005/0211344 | A1 | 9/2005 | Omura et al. | |
| 2005/0232805 | A1 | 10/2005 | Takeda et al. | |
| 2006/0196582 | A1 | 9/2006 | Lindh | |
| 2006/0285993 | A1 | 12/2006 | Rakowski | |
| 2009/0162238 | A1 | 6/2009 | Bergstrom et al. | |
| 2013/0078134 | A1 | 3/2013 | Bergstrom et al. | |
| 2013/0129559 | A1 | 5/2013 | Rakowski et al. | |

FOREIGN PATENT DOCUMENTS

| | | | |
|---|---|---|---|
| EP | 0156778 | A2 | 10/1985 |
| EP | 0171868 | A1 | 2/1986 |
| EP | 0260022 | A2 | 3/1988 |
| EP | 0314649 | B1 | 5/1989 |
| EP | 0694626 | A1 | 1/1996 |
| EP | 0750053 | A1 | 12/1996 |
| EP | 0659896 | B1 | 4/1997 |
| EP | 1061151 | A1 | 12/2000 |
| EP | 1106706 | A1 | 6/2001 |
| EP | 1645649 | A1 | 4/2006 |
| EP | 1690957 | A1 | 8/2006 |
| GB | 882983 | | 11/1961 |
| GB | 1514934 | A | 6/1978 |
| GB | 2075550 | A | 11/1981 |
| GB | 2166159 | A | 4/1986 |
| GB | 2205856 | A | 12/1988 |
| GB | 2359095 | A | 8/2001 |
| JP | 54-041214 | A | 4/1979 |
| JP | 56-119721 | A | 9/1981 |
| JP | 57-63666 | A | 4/1982 |
| JP | 59-211556 | A | 11/1984 |
| JP | 2-305940 | A | 12/1990 |
| JP | 5-247592 | A | 9/1993 |
| JP | 5-295486 | A | 11/1993 |
| JP | 6-128691 | A | 5/1994 |
| JP | 6-224362 | A | 8/1994 |
| JP | 6-314411 | A | 11/1994 |
| JP | 7-060523 | A | 3/1995 |
| JP | 7-233444 | A | 9/1995 |
| JP | 8-085820 | A | 4/1996 |
| JP | 8-170153 | A | 7/1996 |
| JP | 8-260101 | A | 10/1996 |
| JP | 8-283915 | A | 10/1996 |
| JP | 9-241746 | A | 9/1997 |
| JP | 9-302446 | A | 11/1997 |
| JP | 9-310157 | A | 12/1997 |
| JP | 10-102206 | A | 4/1998 |
| JP | 1-172524 | A | 7/1998 |
| JP | 2006-219751 | A | 8/2006 |
| JP | 2008-127590 | A | 6/2008 |
| RU | 2107109 | C1 | 3/1998 |
| RU | 2155821 | C1 | 9/2000 |
| RU | 2167953 | C2 | 5/2001 |
| RU | 2207397 | C2 | 6/2003 |
| RU | 2270269 | C1 | 2/2006 |
| SU | 874761 | A1 | 10/1981 |
| SU | 1301868 | A1 | 4/1987 |
| WO | WO 87/04731 | A1 | 8/1987 |
| WO | WO 98/10888 | A1 | 3/1998 |
| WO | WO 99/32682 | A1 | 7/1999 |
| WO | WO 00/26428 | * | 5/2000 |
| WO | WO 00/026428 | A1 | 5/2000 |
| WO | WO 02/27056 | A1 | 4/2002 |
| WO | WO 03/033755 | A1 | 4/2003 |
| WO | WO 03/038136 | A1 | 5/2003 |
| WO | WO 03/080886 | A1 | 10/2003 |
| WO | WO 2005/001151 | A1 | 1/2005 |
| WO | WO 2005/045082 | A1 | 5/2005 |
| WO | WO 2005/073422 | A1 | 8/2005 |
| WO | WO 2006/071192 | A1 | 7/2006 |
| WO | WO 2009/070345 | A1 | 6/2009 |
| WO | WO 2009/082498 | A1 | 7/2009 |
| WO | WO 2009/082501 | A1 | 7/2009 |
| WO | WO 2010/087766 | A1 | 8/2010 |

OTHER PUBLICATIONS

Stainless Steels Chromium—Nickel Types 302 (S30200), 304(S30400), 304L (S30403), 305 (S30500), Allegheny Ludlum an Allegheny Technologies Company, Technical Data Blue Sheet, Allegheny Ludlum Corporation—Pittsburgh, PA, 1998, pp. 1-10.

"Stainless Steels Types 201 and 201L (UNS Designations S20100 and S20103)", ATI Allegheny Ludlum Allegheny Technologies, Technical Data Blue Sheet, 2005, pp. 1-8.

"Twice the yield strength of 304 stainless with comparable corrosion resistance. Low magnetic permeability retained after severe cold

(56) References Cited

OTHER PUBLICATIONS working. Resistance to chloride stress corrosion cracking superior to 304. Excellent strength and ductility at cryogenic temperatures. Wear and galling resistance superior to the standard austenitic grades", Carlson Alloy Nitronic 33 (ASTM XM-29, UNS S24000), Product Data Bulletin Nitronic 33, 1998, 4 pages.
"Nitrogen-strengthened austenitic stainless steel providing good aqueous corrosion resistance combined with resistance to abrasives and metal-to-metal wear. Higher mechanical properties than standard austenitic grades. Outstanding corrosive wear resistance under many different sliding conditions. Galling resistance equivalent to 304", Carlson Alloy Nitronic 33 (UNS S20400), Product Data Bulletin Nitronic 30, 1998, 2 pages.
Dr. Jacques Charles, "The New 200-Series: An Alternative Answer to NI. Surcharge? Dream or Nightmare?", U & A, Arcelor, Immeuble Pacific-11,13 cours Valmy F-92070 La Defense cedex., Sep. 27-30, 2005, pp. 1-9.
"Stainless Steel Chromium-Nickel-Manganese AL 201LN (UNS Designation S20153)", Allegheny Ludlum—An Allegheny Teledyne Company, Technical Data Blue Sheet, Allegheny Ludlum Corporation, 1998, pp. 1-5.
Allegheny Ludlum Stainless Steel, Type 301 (UNS Designation S30100), Allegheny Ludlum—An Allegheny Technologies Company, Technical Data Blue Sheet, Allegheny Ludlum Corporation, Pittsburgh, PA, 1998, pp. 1-6.
Yasuhiro Habara, "IMnI 30th Annual Conference 2004—Stainless Steel 200 Series: An Opportunity for Mn", Nippon Metal Industry, Co., Ltd., Mar. 2005, 24 pages.
Bridges, W.H., ed., "Metallurgy Division Quarterly Progress Report for Period Ending Oct. 31, 1952," Technical Report, OSTI ID: 4176086, Oak Ridge National Lab., Tenn. Accessed at http://www.osti.gov/energycitations/product.biblio.jsp?osti_id=4176086.
Habashi, F., "Historical Introduction to Refractory Metals," DOI: 10.1080/08827509808962488. Journal: Mineral Processing and Extractive Metallurgy Review, vol. 22, Issue 1 Dec. 1998, pp. 25-53. Accessed at http://www.informaworld.com/smpp/content~content=a779144442~db=all.
Hayes, E., "Chromium and Vanadium," Industrial Engineering and Chemistry, vol. 53, No. 2, pp. 105 (1961). Accessed at http://scholar.google.com/scholar?hl=en&lr=&q=stainless+steel+columbium%2C+vanadium%2C+zirconium+-patents&btnG=Search.
Hübler, R., et al., "Wear and corrosion protection of 316-L femoral implants by deposition of thin films," Surface and Coatings Technology, vols. 142-144, Jul. 2001, pp. 1078-1083. Accessed at http://www.sciencedirect.com/science?_ob=ArticleURL&_udi=B6TVV-43WTXCV-6G&_user=10&_coverDate=07%2F31%2F2001&_rdoc=1&_fmt=&_orig=search&_sort=d&view=c&_acct=C000050221&_version=1&_urlVersion=0&_userid=10&md5=415112522be6420c094812f0c8183ba0.
Kolukisa, S., "The effect of the process temperature on the bondability in diffusion bonding of ferritic (AISI 430) with martensitic (AISI 420) stainless steels," Praktische Metallographie, 2006, vol. 43, No. 5, p. 252-261. Pascal. © 2007 INIST/CNRS. Dialog® File No. 144 Accession No. 18213150.
Li, Ping et al., "Failure analysis of the impeller of slurry pump used in zinc hydrometallurgy process," Engineering Failure Analysis, vol. 13, Issue 6, Sep. 2006, pp. 876-885. Accessed at http://www.sciencedirect.com/science?_ob=ArticleURL&_udi=B6V2X-4H21NH4-2&_user=10&_coverDate=09%2F30%2F2006&_rdoc=1&_fmt=&_orig=search&_sort=d&view=c&_acct=C000050221&_version=1&_urlVersion=-0&_userid=10&md5=401b17449fa1c06a3cf468b8915df5078.
MacLeary, D.L., "Testing of Columbium and Columbium Alloys," Date Feb. 1, 1962 OSTI ID: 4810118. Journal: Corrosion; vol. 18, pp. 67t-9t. Accessed at http://www.osti.gov/energycitations/product.biblio.jsp?osti_id=4810118.
Ogawa, K., "Super duplex stainless steel and its weldability," Journal: Recent Progress in Welding Technology from the Viewpoint of Use of Stainless Steels, vol.;No.; p. 25-30(2002). Accessed at http://sciencelinks.jp/j-east/article/200306/000020030603A0127311.php.
Okamoto, H., "The Effect of Tungsten and Molybdenum on the Performance of Super Duplex Stainless Steels," Applications of Stainless Steel '92. vol. 1; Stockholm; Sweden; Jun. 9-11, 1992. pp. 360-369. 1992. Accessed at http://md1.csa.com/partners/viewrecord.php?requester=gs&collection=TRD&recid=153063WS&recid=199307351097MD&q=PREw+and+stainless+steel+-patents&uid=789942086&setcookie=yes.
Okamoto, H., et al., "A new tungsten alloyed super Duplex Stainless Steel," Sumitomo Search, No. 54, p. 21-9, Oct. 1993, Inspec. Dialog® File No. 2 Accession No. 5652729.
Park, J.-Y., et al., "The effects of heat-treatment parameters on corrosion resistance and phase transformations of 14Cr-3Mo martensitic stainless steel" Conference: RQ12: International Conference on Rapidly Quenched & Metastable Materials, 12, (Jeju Island Kor), Aug. 2, 2005. Materials science & engineering. A, Structural materials: properties, microstructure and processing, 2007, vol. 449-451 , p. 1131-1134. Pascal. Dialog® File No. 144 Accession No. 18102654.
Park, J.Y., et al., "Effects of austenitizing treatment on the corrosion resistance of 14Cr-3Mo martensitic stainless steel," Corrosion : (Houston, Tex.), 2006, vol. 62, No. 6, p. 541-547. Pascal. Dialog® File No. 144 Accession No. 17993399.
Park, H.S., "A study on alloy design of duplex stainless steel. Consideration on the difference of corrosion resistance between ferrite and austenite," Journal of the Corrosion Science Society of Korea, vol. 28, No. 1, pp. 78-92. Feb. 1999. Accessed at http://md1.csa.com/partners/viewrecord.php?requester=gs&collection=TRD&recid=199910352358MD&recid=993480CO&q=PREw+and+stainless+steel+-patents&uid=789942086&setcookie=yes.
Scott, C., et al., "Microalloying with Vanadium for Improved Cold Rolled Trip Steels," International Seminar 2005 on Application Technologies of Vanadium in Flat—Rolled Steels. Accessed at http://www.vanitec.org/pages/en/index.php.
Ueda, M., et al., "Performance of high resistant duplex stainless steel in chloride and sour environments," National Association of Corrosion Engineers, Corrosion-Resistant Alloys in Oil and Gas Production. vol. I (USA), 1996, pp. 588-608, 1996. Accessed at http://md1.csa.com/partners/viewrecord.php?requester=gs&collection=TRD&recid=199712352351MD&q=PREw+and+stainless+steel+-patents&uid=789942086&setcookie=yes.
Bergstrom, D.S., "AL 201HP (UNS S20100) alloy: a high-performance, lower-nickel alternative to 300 series alloys", ATI Allegheny Ludlum, an Allegheny Technologies Company, 2005, 8 pages.
Magee, J., "Development of Type 204 CU Stainless, A Low-Cost Alternate to Type 304", Carpenter Technology Corporation, Reading, PA, Jan. 2001. Accessed at http://crswnew.cartech.com/wnew/techarticles/TA00013.html on May 29, 2008.
Stainless Steel AL 2205 TM Alloy (UNS Designation S31803), Allegheny Ludlum, An Allegheny Teledyne Company, Technical Data Blue Sheet, Allegheny Ludlum Corporation—Pittsburgh, PA, 1998, 6 pages.
Alloys Make the Grade; "Welcome to AK Steel's Family of Stainless Steels"; "AK Steel, Stainless Steel Comparator"; "AK Steel Coated Stainless Steels"; "Glossary of Stainless Sheet and Strip Terms", AK Steel, 2000, 8 pages.
Goldschtain, M.I. et al., "Special Steels", Moscow, 'Metallurgy' Publisher, 1985, pp. 101-103 accompanied by English abstract.
J&L Specialty Steel, Inc. Commercial Products—Type 2205 (UNS 31803) Duplex Stainless Steel. [Accessed at http://www.jlspecialty.com/data/2205.htm on Aug. 8, 2001].
Dezurik, "2205 Duplex Stainless Steel", Application Data 10.60-4, Jul. 1999, 3 pages.
Duplex Stainless Steel AL 2003 TM Alloy (UNS S32003), ATI Allegheny Ludlum, Allegheny Technologies, Technical Data Blue Sheet, 2006.
ASM International, Materials Park, Ohio, Metallographer's Guide: Practices and Procedures for Irons and Steels, Chapter 1, "Introduction to Steels and Cast Irons", p. 3, 1999.
J&L Type 201, "Austenitic Manganese Stainless Steel," Alloy Digest, ASM International, Nov. 1999, 2 pages.

(56) References Cited

OTHER PUBLICATIONS

Stahlschlussel, "Key to Steel", 10th Edition, 1974, West Germany, 3 pages.
"Hot forming and heat treatment of duplex stainless steels", Shop Sheet, International Molybdenum Association, 1999, 100-101.
Pradhan, R., "Continuous Annealing of Steel", Heat Treating, vol. 4, ASM Handbook, ASM International, 1991, printed from http://products/asminternational.org, 3 pages.
"Forming of Stainless Steel and Heat-Resistant Alloys", ASM Handbook, ASM International, 2002, printed from http://products/asminternational.org, 2 pages.
Office Action mailed Jul. 15, 2010 in U.S. Appl. No. 12/034,183.
Office Action mailed Dec. 2, 2010 in U.S. Appl. No. 12/034,183.
Office Action mailed May 18, 2011 in U.S. Appl. No. 12/034,183.
Office Action mailed Sep. 9, 2011 in U.S. Appl. No. 12/034,183.
Notice of Allowance mailed Dec. 6, 2011 in U.S. Appl. No. 12/034,183.
Office Action mailed May 10, 2012 in U.S. Appl. No. 12/034,183.
Notice of Allowance mailed Sep. 10, 2012 in U.S. Appl. No. 12/034,183.
Office Action mailed Dec. 2, 2010 in U.S. Appl. No. 12/610,577.
Office Action mailed Jul. 15, 2010 in U.S. Appl. No. 12/610,577.
Office Action mailed May 18, 2011 in U.S. Appl. No. 12/610,577.
Office Action mailed Sep. 9, 2011 in U.S. Appl. No. 12/610,577.
Notice of Allowance mailed Dec. 1, 2011 in U.S. Appl. No. 12/610,577.
Office Action mailed May 15, 2012 in U.S. Appl. No. 12/610,577.
Notice of Allowance mailed Sep. 7, 2012 in U.S. Appl. No. 12/610,577.
Response to Rule 312 Communication mailed Oct. 29, 2012 in U.S. Appl. No. 12/610,577.
Office Action mailed Jul. 15, 2010 in U.S. Appl. No. 12/037,477.
Office Action mailed Dec. 2, 2010 in U.S. Appl. No. 12/037,477.
Office Action mailed May 18, 2011 in U.S. Appl. No. 12/037,477.
Office Action mailed Dec. 14, 2011 in U.S. Appl. No. 12/037,477.
Notice of Allowance mailed Feb. 28, 2012 in U.S. Appl. No. 12/037,477.
Office Action mailed Jul. 27, 2012 in U.S. Appl. No. 12/037,477.
Notice of Allowance mailed Sep. 10, 2012 in U.S. Appl. No. 12/037,477.
Office Action mailed Jul. 15, 2010 in U.S. Appl. No. 12/037,199.
Office Action mailed Dec. 9, 2010 in U.S. Appl. No. 12/037,199.
Office Action mailed May 19, 2011 in U.S. Appl. No. 12/037,199.
Office Action mailed Dec. 14, 2011 in U.S. Appl. No. 12/037,199.
Office Action mailed May 10, 2012 in U.S. Appl. No. 12/037,199.
Office Action mailed Sep. 10, 2012 in U.S. Appl. No. 12/037,199.
Advisory Action mailed Nov. 13, 2012 in U.S. Appl. No. 12/037,199.
Office Action mailed May 10, 2013 in U.S. Appl. No. 12/037,199.
Office Action mailed Nov. 13, 2013 in U.S. Appl. No. 12/037,199.
Advisory Action mailed Dec. 6, 2013 in U.S. Appl. No. 12/037,199.
Office Action mailed Mar. 7, 2014 in U.S. Appl. No. 12/037,199.
ASM International, Materials Park, Ohio, Metallographer's Guide: Practices and Procedures for Irons and Steels, Chapter 1, "Introduction to Steels and Cast Irons", Table 1.1, p. 3, 1997.

* cited by examiner

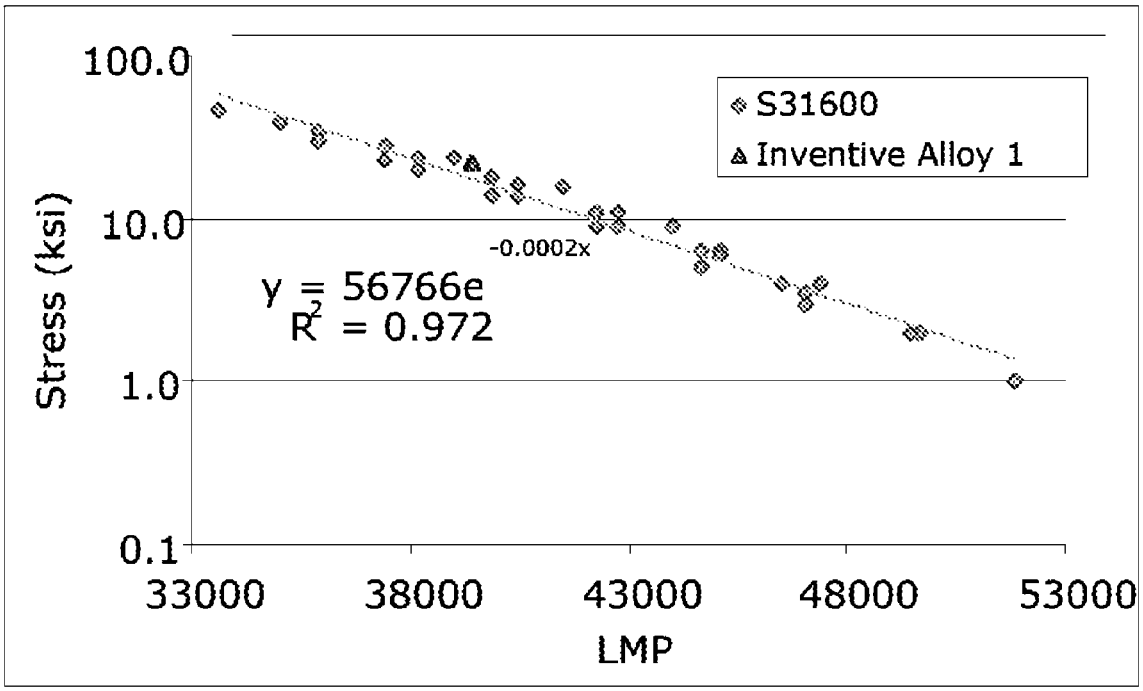
100.0
10.0
1.0
0.1
Stress (ksi)
S31600
Inventive Alloy 1
-0.0002x
y = 56766e
R² = 0.972
33000
38000
43000
48000
53000
LMP

LEAN AUSTENITIC STAINLESS STEEL

CROSS-REFERENCE TO RELATED APPLICATIONS

This application is a continuation application claiming priority under 35 U.S.C. §120 to now U.S. Pat. No. 8,313,691 issued Nov. 20, 2012 U.S. patent application Ser. No. 12/037,477, filed on Feb. 26, 2008, which claims priority under 35 U.S.C. §119(e) to U.S. Provisional Patent Application Ser. No. 60/991,016, filed Nov. 29, 2007.

BACKGROUND

1. Field of Technology

The present disclosure relates to an austenitic stainless steel. In particular, the disclosure relates to a cost-effective austenitic stainless steel composition having low nickel and low molybdenum with at least comparable corrosion resistance and formability properties relative to higher nickel alloys.

2. Description of the Background of the Technology

Austentic stainless steels exhibit a combination of highly desirable properties that make them useful for a wide variety of industrial applications. These steels possess a base composition of iron that is balanced by the addition of austenite-promoting and stabilizing elements, such as nickel, manganese, and nitrogen, to allow additions of ferrite-promoting elements, such as chromium and molybdenum, which enhance corrosion resistance, to be made while maintaining an austenitic structure at room temperature. The austenitic structure provides the steel with highly desirable mechanical properties, particularly toughness, ductility, and formability.

An example of an austenitic stainless steel is AISI Type 316 stainless steel (UNS S31600), which is 16-18% chromium, 10-14% nickel, and 2-3% molybdenum-containing alloy. The ranges of alloying ingredients in this alloy are maintained within the specified ranges in order to maintain a stable austenitic structure. As is understood by one skilled in the art, nickel, manganese, copper, and nitrogen content, for example, contribute to the stability of the austenitic structure. However, the rising costs of nickel and molybdenum have created the need for cost-effective alternatives to S31600 which still exhibit high corrosion resistance and good formability. Recently, lean duplex alloys such as UNS S32003 (AL 2003™ alloy) have been used as lower-cost alternatives to S31600, but while these alloys have good corrosion resistance, they contain approximately 50% ferrite, which gives them higher strength and lower ductility than S31600, and as a consequence, they are not as formable. Duplex stainless steels are also more limited in use for both high and low temperatures, as compared to S31600.

Another alloy alternative is Grade 216 (UNS S21600), which is described in U.S. Pat. No. 3,171,738. S21600 contains 17.5-22% chromium, 5-7% nickel, 7.5-9% manganese, and 2-3% molybdenum, Although S21600 is a lower nickel, higher manganese variant of S31600, the strength and corrosion resistance properties of S21600 are much higher than those of S31600. However, as with the duplex alloys, the formability of S21600 is not as good as that of S31600. Also, because S21600 contains the same amount of molybdenum as does S31600, there is no cost savings for molybdenum.

Other examples include numerous stainless steels in which nickel is replaced with manganese to maintain an austenitic structure, such as is practiced with Type 201 steel (UNS S20100) and similar grades. Although Type 201 steel, for example, is a low-nickel alloy having good corrosion resistance, it has poor formability properties. There is a need to be able to produce an alloy having a combination of both corrosion resistance and formability properties similar to S31600, while containing a lower amount of nickel and molybdenum so as to be cost-effective. Furthermore, there is a need for such an alloy to have, unlike duplex alloys, a temperature application range comparable to that of standard austenitic stainless steels, for example from cryogenic temperatures up to 1000° F.

Accordingly, the present invention provides a solution that is not currently available in the marketplace, which is a formable austenitic stainless steel alloy composition that has comparable corrosion resistance properties to S31600 but provides raw material cost savings. Accordingly, the invention is an austenitic alloy that uses a combination of the elements Mn, Cu, and N, to replace Ni and Mo in a manner to create an alloy with similar properties to those of higher nickel and molybdenum alloys at a significantly lower raw material cost. Optionally, the elements W and Co may be used independently or in combination to replace the elements Mo and Ni, respectively.

SUMMARY

The invention is an austenitic stainless steel that uses less expensive elements, such as manganese, copper, and nitrogen as substitutes for the more costly elements of nickel and molybdenum. The result is a lower cost alloy that has at least comparable corrosion resistance and formability properties to more costly alloys, such as S31600.

An embodiment according to the present disclosure is an austenitic stainless steel including, in weight %, up to 0.20 C, 2.0-9.0 Mn, up to 2.0 Si, 16.0-23.0 Cr, 1.0-5.0 Ni, up to 3.0 Mo, up to 3.0 Cu, 0.1-0.35 N, up to 4.0 W, up to 0.01 B, up to 1.0 Co, iron and impurities, the steel having a ferrite number of less than 10 and a $MD_{30}$ value of less than 20° C. In certain embodiments of the steel, the $MD_{30}$ value is less than −10'C. In certain embodiments of the steel, the steel has a $PRE_W$ value greater than about 22. In certain embodiments of the steel, $0.5 \leq (Mo+W/2) \leq 5.0$.

Another embodiment of the austenitic stainless steel according to the present disclosure includes, in weight %, up to 0.10C, 2.0-8.0 Mn, up to 1.0 Si, 16.0-22.0 Cr, 1.0-5.0 Ni, 0.40-2.0 Mo, up to 1.0 Cu, 0.12-0.30 N, 0.050-0.60 W, up to 1.0 Co, up to 0.04 P, up to 0.03 S, up to 0.008 B, iron and impurities, the steel having a ferrite number of less than 10 and a $MD_{30}$ value of less than 203° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

Yet another embodiment of the austenitic stainless steel according to the present disclosure includes, in weight %, up to 0.08 C, 3.0-6.0 Mn, up to 1.0 Si, 17.0-21.0 Cr, 3.0-5.0 Ni, 0.50-2.0 Mo, up to 1.0 Cu, 0.14-0.30 N, up to 1.0 Co, 0.05-0.60 W, up to 0.05 P, up to 0.03 S, iron and impurities, the steel having a ferrite number of less than 10 and a $MD_{30}$ value of less than 20° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

A further embodiment of the austenitic stainless steel according to the present disclosure consists of, in weight %, up to 0.20 C, 2.0-9.0 Mn, up to 2.0 Si, 16.0-23.0 Cr, 1.0-5.0 Ni, up to 3.0 Mo, up to 3.0 Cu, 0.1-0.35 N, up to 4.0 W, up to 0.01 B, up to 1.0 Co, balance iron and impurities, the steel having a ferrite number of less than 10 and a $MD_{30}$ value of less than 20° C.

In an embodiment, a method of producing an austenitic stainless steel includes melting in an electric arc furnace, refining in an AOD, casting into ingots or continuously cast slabs, reheating the ingots or slabs and hot rolling to produce plates or coils, cold rolling to a specified thickness, and annealing and pickling the material. Other methods according to the invention may include for example, melting and/or re-melting in a vacuum or under a special atmosphere, casting into shapes, or the production of a powder that is consolidated into slabs or shapes, and the like.

Alloys according to the present disclosure may be used in numerous applications. According to one example, alloys of the present disclosure may be included in articles of manufacture adapted for use in low temperature or cryogenic environments. Additional non-limiting examples of articles of manufacture that may be fabricated from or include the present alloys are corrosion resistant articles, corrosion resistant architectural panels, flexible connectors, bellows, tube, pipe, chimney liners, flue liners, plate frame heat exchanger parts, condenser parts, parts for pharmaceutical processing equipment, part used in sanitary applications, and parts for ethanol production or processing equipment.

BRIEF DESCRIPTION OF THE FIGURES

FIG. 1 is a graph showing stress-rupture results for one embodiment of an alloy according to the present disclosure and for Comparative Alloy S31600.

DETAILED DESCRIPTION

In the present description and in the claims, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description and the attached claims are approximations that may vary depending upon the desired properties one seeks to obtain in the product and methods according to the present disclosure. At the very least, and not as an attempt to limit the application of the doctrine of equivalents to the scope of the claims, each numerical parameter should at least be construed in light of the number of reported significant digits and by applying ordinary rounding techniques. The austenitic stainless steels of the present invention will now be described in detail. In the following description, "%" represents "weight %", unless otherwise specified.

The invention is directed to an austenitic stainless steel. In particular, the invention is directed to an austenitic stainless steel composition that has at least comparable corrosion resistance and formability properties to those of S31600. An embodiment of an austenitic stainless steel according to the present disclosure includes, in weight %, up to 0.20 C, 2.0-9.0 Mn, up to 2.0 Si, 16.0-23.0 Cr, 1.0-5.0 Ni, up to 3.0 Mo, up to 3.0 Cu, 0.1-0.35 N, up to 4.0 W, up to 0.01 B, up to 1.0 Co, iron and impurities, the steel having a ferrite number of less than 10 and a $MD_{30}$ value of less than 20° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

Another embodiment of the austenitic stainless steel according to the present disclosure includes, in weight To, up to 0.10 C, 2.0-8.0 Mn, up to 1.0 Si, 16.0-22.0 Cr, 1.0-5.0 Ni 0.40-2.0 Mo, up to 1.0 Cu, 0.12-0.30 N, 0.05-0.60 W, up to 1.0 Co, up to 0.04 P, up to 0.03 S, up to 0.008 B, iron and impurities, the steel having a ferrite number of less than 10 and a $MD_{30}$ value of less than 20° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

Yet another embodiment of the austenitic stainless steel according to the present disclosure includes, in weight %, up to 0.08 C, 3.0-6.0 Mn, up to 1.0 Si, 17.0-21.0 Cr, 3.0-5.0 Ni, 0.50-2.0 Mo, up to 1.0 Cu, 0.14-0.30 N, up to 1.0 Co, 0.05-0.60 W, up to 0.05 P, up to 0.03 5, iron and impurities, the steel having a ferrite number of less than 10 and a $MD_{30}$ value of less than 20° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

A further embodiment of the austenitic stainless steel according to the present disclosure includes, in weight %, up to 0.20 C, 2.0-9.0 Mn, up to 2.0 Si, 16.0-23.0 Cr, 3.0-5.0 Ni, up to 3.0 Mo, up to 3.0 Cu, 0.1-0.35 N, up to 4.0 W, up to 0.01 B, up to 1.0 Co, iron and impurities, the steel having a ferrite number of less than 10 and a $MD_{30}$ value of less than 20° C. In certain embodiments of the steel, the $MD_{30}$ value is less than −10° C. In certain embodiments of the steel, the steel has a $PRE_W$ value greater than about 22. In certain embodiments of the steel, $0.5 \leq (Mo+W/2) \leq 5.0$.

A further embodiment of the austenitic stainless steel according to the present disclosure consists of, in weight %, up to 0.20 C, 2.0-9.0 Mn, up to 2.0 Si, 16.0-23.0 Cr, 1.0-5.0 Ni, up to 3.0 Mo, up to 3.0 Cu, 0.1-0.35 N, up to 4.0 W, up to 0.01 B, up to 1.0 Co, balance iron and impurities, the steel having a ferrite number of less than 10 and a $MD_{30}$ value of less than 20° C.

C: Up to 0.20%

C acts to stabilize the austenite phase and inhibits deformation-induced martensitic transformation. However C also increases the probability of forming chromium carbides, especially during welding, which reduces corrosion resistance and toughness. Accordingly, the austenitic stainless steel of the present invention has up to 0.20% C. In an embodiment of the invention, the content of C may be 0.10% or less or, alternatively may be 0.08% or less.

Si: Up to 2.0%

Having greater than 2% Si promotes the formation of embrittling phases, such as sigma, and reduces the solubility of nitrogen in the alloy. Si also stabilizes the ferritic phase, so greater than 2% Si requires the addition of additional austenite stabilizers to maintain the austenitic phase. Accordingly, the austenitic stainless steel of the present invention has up to 2.0% Si. In an embodiment according to the present disclosure, the Si content may be 1.0% or less. In another embodiment of the invention, the Si content may be 0.50% or less.

Mn: 2.0-9.0%

Mn stabilizes the austenitic phase and generally increases the solubility of nitrogen, a beneficial alloying element. To sufficiently produce these effects, a Mn content of not less than 2.0% is required. Both manganese and nitrogen are effective substitutes for the more expensive element, nickel. However, having greater than 9.0% Mn degrades the material's workability and its corrosion resistance in certain environments. Also, because of the difficulty in decarburizing stainless steels with high levels of Mn, such as greater than 9.0%, having too much Mn significantly increases the processing costs of manufacturing the material. Accordingly, the austenitic stainless steel of the present invention has 2.0-9.0% Mn. In an embodiment, the Mn content may be 2.0-8.0%, or alternatively may be 3.0-6.0%.

Ni: 1.0-5.0%

At least 1% Ni is required to stabilize the austenitic phase with respect to both ferrite and martensite formation. Ni also acts to enhance toughness and formability. However, due to the relatively high cost of nickel, it is desirable to keep the nickel content as low as possible. The inventors have found that 1.0-5.0% range of Ni can be used in addition to the other defined ranges of elements to achieve an alloy having corrosion resistance and formability as good as or better than those of higher nickel alloys. Accordingly, the austenitic stainless steel of the present invention has 1.0-5.0% Ni. In an embodiment, the Ni content may be 3.0-5.0%. In another embodiment, the Ni content may be 1.0-3.0%.

Cr: 16.0-23.0%

Cr is added to impart corrosion resistance to stainless steels and also acts to stabilize the austenitic phase with respect to martensitic transformation. At least 16% Cr is required to provide adequate corrosion resistance. On the other hand, because Cr is a powerful ferrite stabilizer, a Cr content exceeding 23% requires the addition of more costly alloying elements, such as nickel or cobalt, to keep the ferrite content acceptably low. Having more than 23% Cr also makes the formation of undesirable phases, such as sigma, more likely. Accordingly, the austenitic stainless steel of the present invention has 16.0-23.0% Cr. In an embodiment, the Cr content may be 16.0-22.0%, or alternatively may be 17.0-21.0%.

N: 0.1-0.35%

N is included in the alloy as a partial replacement for the austenite stabilizing element Ni and the corrosion enhancing element Mo. At least 0.10% N is necessary for strength and corrosion resistance and to stabilize the austenitic phase. The addition of more than 0.35% N may exceed the solubility of N during melting and welding, which results in porosity due to nitrogen gas bubbles. Even if the solubility limit is not exceeded, a N content of greater than 0.35% increases the propensity for the precipitation of nitride particles, which degrades corrosion resistance and toughness. Accordingly, the austenitic stainless steel of the present invention has 0.1-0.35% N. In an embodiment, the N content may be 0.14-0.30%, or alternatively, may be 0.12-0.30%.

Mo: up to 3.0%

The present inventors sought to limit the Mo content of the alloy while maintaining acceptable properties. Mo is effective in stabilizing the passive oxide film that forms on the surface of stainless steels and protects against pitting corrosion by the action of chlorides. In order to obtain these effects, Mo may be added in this invention up to a level of 3.0%. Due to its cost, the Mo content may be 0.5-2.0%, which is adequate to provide the required corrosion resistance in combination with the proper amounts of chromium and nitrogen. A Mo content exceeding 3.0% causes deterioration of hot workability by increasing the fraction of solidification (delta) ferrite to potentially detrimental levels. High Mo content also increases the likelihood of forming deleterious intermetallic phases, such as sigma phase. Accordingly, the austenitic stainless steel composition of the present invention has up to 3.0% Mo. In an embodiment, the Mo content may be about 0.40-2.0%, or alternatively may be 0.50-2.0%.

Co: Up to 1.0%

Co acts as a substitute for nickel to stabilize the austenite phase. The addition of cobalt also acts to increase the strength of the material. The upper limit of cobalt is preferably 1.0%.

B: Up to 0.01%

Additions as low as 0.0005% B may be added to improve the hot workability and surface quality of stainless steels. However, additions of more than 0.01% degrade the corrosion resistance and workability of the alloy. Accordingly, the austenitic stainless steel composition of the present invention has up to 0.01% B. In an embodiment, the B content may be up to 0.008%.

Cu: up to 3.0%

Cu is an austenite stabilizer and may be used to replace a portion of the nickel in this alloy. It also improves corrosion resistance in reducing environments and improves formability by reducing the stacking fault energy. However, additions of more than 3% Cu have been shown to reduce the hot workability of austenitic stainless steels. Accordingly, the austenitic stainless steel composition of the present invention has up to 3.0% Cu. In an embodiment, Cu content may be up to 1.0%.

W: Up to 4.0%

W provides a similar effect to that of molybdenum in improving resistance to chloride pitting and crevice corrosion. W may also reduce tendency for sigma phase formation when substituted for molybdenum. However, additions of more than 4% may reduce the hot workability of the alloy. Accordingly, the austenitic stainless steel composition of the present invention has up to 4.0% W. In an embodiment, W content may be 0.05-0.60%.

$0.5 \leq (Mo+W/2) \leq 5.0$

Mo and W are both effective in stabilizing the passive oxide film that forms on the surface of stainless steels and protects against pitting corrosion by the action of chlorides. Since W is approximately half as effective (by weight) as Mo in increasing corrosion resistance, a combination of $(Mo+W/2) > 0.5\%$ is required to provide the necessary corrosion resistance. However, having too much Mo increases the likelihood of forming intermetallic phases and too much W reduces the hot workability of the material. Therefore, the combination of (Mo+W/2) should be less than 5.0%. Accordingly, the austenitic stainless steel composition of the present invention has $0.5 \leq (Mo+W/2) \leq 5.0$.

$1.0 \leq (Ni+Co) \leq 6.0$

Nickel and cobalt both act to stabilize the austenitic phase with respect to ferrite formation. At least 1.0% of (Ni+Co) is required to stabilize the austenitic phase in the presence of ferrite stabilizing elements such as chromium and molybdenum, which must be added to ensure proper corrosion resistance. However, both Ni and Co are costly elements, so it is desirable to keep the (Ni+Co) content less than 6.0%. Accordingly, the austenitic stainless steel composition of the present invention has $1.0 \leq (Ni+Co) \leq 6.0$.

The balance of the austenitic stainless steel of the present invention includes iron and unavoidable impurities, such as phosphorus and sulfur. The unavoidable impurities are preferably kept to the lowest practical level, as understood by one skilled in the art.

The austenitic stainless steel of the present invention can also be defined by equations that quantify the properties they exhibit, including, for example, pitting resistance equivalence number, ferrite number, and $MD_{30}$ temperature.

The pitting resistance equivalence number ($PRE_N$) provides a relative ranking of an alloy's expected resistance to pitting corrosion in a chloride-containing environment. The higher the $PRE_N$, the better the expected corrosion resistance of the alloy. The $PRE_N$ can be calculated by the following formula:

$$PRE_N = \%\ Cr + 3.3(\%\ Mo) + 16(\%\ N)$$

Alternatively, a factor of 1.65(% W) can be added to the above formula to take into account the presence of tungsten in an alloy. Tungsten improves the pitting resistance of stainless steels and is about half as effective as molybdenum by weight. When tungsten is included in the calculation, the pitting resistance equivalence number is designated as $PRE_W$ which is calculated by the following formula:

$$PRE_W = \%\ Cr + 3.3(\%\ Mo) + 1.65(\%\ W) + 16(\%\ N)$$

Tungsten serves a similar purpose as molybdenum in the invented alloy. As such, tungsten may be added as a substitute for molybdenum to provide increased pitting resistance. According to the equation, twice the weight percent of tungsten should be added for every percent of molybdenum removed to maintain the same pitting resistance. Certain embodiments of the alloy of the present invention have $PRE_W$, values greater than 22, and in certain preferred embodiments is as high as 30.

The alloy of the invention also may be defined by its ferrite number. A positive ferrite number generally correlates to the presence of ferrite, which improves an alloy's solidification properties and helps to inhibit hot cracking of the alloy during hot working and welding operations. A small amount of ferrite is thus desired in the initial solidified microstructure for good castability and for prevention of hot-cracking during welding. On the other hand, too much ferrite can result in problems during service, including but not limited to, microstructural instability, limited ductility, and impaired high temperature mechanical properties. The ferrite number can be calculated using the following equation:

$$FN = 3.34(Cr + 1.5Si + Mo + 2Ti + 0.5Cb) - 2.46(Ni + 30N + 30C + 0.5Mn + 0.5Cu) - 28.6$$

The alloy of the present invention has a ferrite number of up to 10, preferably a positive number, more preferably about 3 to 5.

The $MD_{30}$ temperature of an alloy is defined as the temperature at which cold deformation of 30% will result in a transformation of 50% of the austenite to martensite. The lower the $MD_{30}$ temperature is, the more resistant a material is to martensite transformation. Resistance to martensite formation results in a lower work hardening rate, which results in good formability, especially in drawing applications. $MD_{30}$ is calculated according to the following equation:

$$MD_{30}(^\circ\ C.) = 413 - 462(C+N) - 9.2Si - 8.1Mn - 13.7Cr - 9.5Ni - 17.1Cu - 18.5Mo$$

The alloy of the present invention has a $MD_{30}$ temperature of less than 20° C., and in certain preferred embodiments is less than about −10° C.

EXAMPLES

Table 1 includes the actual compositions and calculated parameter values for Inventive Alloys 1-11 and for Comparative Alloys CA1, S31600, S21600, and S20100.

Inventive Alloys 1-11 and Comparative Alloy CA1 were melted in a laboratory-size vacuum furnace and poured into 50-lb ingots. These ingots were re-heated and hot rolled to produce material about 0.250" thick. This material was annealed, blasted, and pickled. Some of that material was cold rolled to 0.100" thick, and the remainder was cold rolled to 0.050 or 0.040" thick. The cold rolled material was annealed and pickled. Comparative Alloys S31600, S21600, and S20100 are commercially available and the data shown for these alloys were taken from published literature or measured from testing of material recently produced for commercial sale.

The calculated $PRE_W$ values for each alloy are shown in Table 1. Using the equation discussed herein above, the alloys having a $PRE_w$ greater than 24.1 would be expected to have better resistance to chloride pitting than S31600 material, while those having a lower $PRE_W$ would pit more easily.

The ferrite number for each alloy in Table 1 has also been calculated. The ferrite numbers of the Inventive Alloys are less than 10, specifically between −3.3 and 8.3. While the ferrite number for some of the Inventive Alloys may be slightly lower than desired for optimum weldability and castability, they are still higher than that of Comparative Alloy S21600, which is a weldable material.

The MD values were also calculated for the alloys in Table 1. According to the calculations, all of the Inventive Alloys exhibit greater resistance to martensite formation than Comparative Alloy S31600.

TABLE 1

| | Inventive Alloys | | | | | | | |
|---|---|---|---|---|---|---|---|---|
| | 1 | 2 | 3 | 4 | 5 | 6 | 7 | 8 |
| C | 0.019 | 0.17 | 0.023 | 0.016 | 0.016 | 0.013 | 0.013 | 0.014 |
| Mn | 4.7 | 4.9 | 5.7 | 4.0 | 4.8 | 4.9 | 5.1 | 5.1 |
| Si | 0.28 | 0.26 | 0.28 | 0.27 | 0.25 | 0.27 | 0.25 | 0.24 |
| Cr | 18.1 | 18.0 | 18.0 | 18.3 | 18.0 | 18.0 | 18.2 | 18.2 |
| Ni | 4.5 | 4.6 | 4.1 | 4.9 | 4.5 | 4.2 | 4.5 | 1.0 |
| Mo | 1.13 | 1.0 | 1.02 | 1.17 | 0.82 | 1.0 | 1.0 | 1.15 |
| Cu | 0.40 | 0.39 | 0.37 | 0.42 | 0.42 | 0.99 | 1.89 | 0.40 |
| N | 0.210 | 0.142 | 0.275 | 0.161 | 0.174 | 0.185 | 0.216 | 0.253 |
| P | 0.002 | 0.017 | 0.018 | 0.012 | 0.013 | 0.018 | 0.014 | 0.014 |
| S | 0.0001 | 0.0011 | 0.0023 | 0.0015 | 0.0017 | 0.0014 | 0.0018 | 0.0015 |
| W | 0.09 | 0.12 | 0.01 | 0.01 | 0.36 | 0.12 | 0.04 | 0.09 |
| B | 0.001 | 0.0025 | 0.0018 | 0.0022 | 0.0020 | 0.0021 | 0.0026 | 0.0014 |
| Fe | 70.4 | 70.5 | 70.1 | 70.7 | 70.6 | 70.2 | 68.7 | 73.5 |
| Co | 0.10 | 0.10 | 0.04 | 0.09 | 0.10 | 0.10 | 0.10 | 0.10 |
| FN | 2.8 | 6.7 | −3.3 | 7.1 | 3.9 | 3.7 | 0.2 | 8.3 |
| $PRE_W$ | 25.5 | 23.9 | 25.8 | 24.7 | 24.6 | 24.6 | 25.0 | 26.3 |
| $MD_{30}$ | −52.4 | −17.2 | −84.1 | −28.9 | −27.4 | −42.5 | −78.3 | −40.1 |
| RMCI | 0.56 | 0.55 | 0.52 | 0.58 | 0.54 | 0.53 | 0.54 | 0.38 |
| Yield | 49.1 | — | 51.3 | 46.4 | 49.2 | 49.4 | 46.6 | 61.5 |
| Tensile | 108.7 | — | 108.5 | 103.3 | 104.6 | 104.1 | 97.6 | 127.6 |
| % E | 68 | — | 65 | 56 | 52 | 48 | 50.0 | 49.5 |
| OCH | 0.45 | — | 0.41 | 0.42 | 0.40 | 0.39 | 0.42 | 0.32 |
| SSCVN | 61.7 | — | 59.0 | 69.7 | 65.7 | 66.0 | 54.7 | 51.7 |

TABLE 1-continued

| | Inventive Alloys | | | Comparative Alloys | | | |
|---|---|---|---|---|---|---|---|
| | 9 | 10 | 11 | CA1 | S31600 | S21600 | S20100 |
| C | 0.015 | 0.011 | 0.016 | 0.015 | 0.017 | 0.018 | 0.02 |
| Mn | 4.5 | 5.1 | 4.9 | 4.8 | 1.24 | 8.3 | 6.7 |
| Si | 0.25 | 0.28 | 0.29 | 0.26 | 0.45 | 0.40 | 0.40 |
| Cr | 17.3 | 18.1 | 18.1 | 16.1 | 16.3 | 19.7 | 16.4 |
| Ni | 4.6 | 4.5 | 3.7 | 3.5 | 10.1 | 6.0 | 4.1 |
| Mo | 0.36 | 1.13 | 0.75 | 0.82 | 2.1 | 2.5 | 0.26 |
| Cu | 0.40 | 0.40 | 0.40 | 0.42 | 0.38 | 0.40 | 0.43 |
| N | 0.184 | 0.153 | 0.158 | 0.138 | 0.04 | 0.37 | 0.15 |
| P | 0.015 | 0.014 | 0.014 | 0.013 | 0.03 | 0.03 | 0.03 |
| S | 0.0015 | 0.0020 | 0.0019 | 0.0015 | 0.0010 | 0.0010 | 0.0010 |
| W | 1.38 | 0.09 | 0.04 | 0.01 | 0.11 | 0.10 | 0.1 |
| B | 0.0013 | 0.0022 | 0.0024 | 0.0022 | 0.0025 | 0.0025 | 0.0005 |
| Fe | 70.9 | 69.4 | 71.7 | 73.8 | 68.8 | 62.2 | 71.4 |
| Co | 0.11 | 0.89 | 0.10 | 0.10 | 0.35 | 0.10 | 0.10 |
| FN | −0.3 | 7.0 | 7.4 | 3.1 | 4.1 | −6.2 | −2.3 |
| $PRE_W$ | 26.0 | 24.5 | 23.2 | 21.1 | 24.0 | 33.9 | 19.7 |
| $MD_{30}$ | −11.8 | −24.1 | −12.2 | 24.6 | 7.8 | −217.4 | 0.7 |
| RMCI | 0.55 | 0.56 | 0.47 | 0.45 | 1.00 | 0.83 | 0.43 |
| Yield | 50.6 | 48.0 | 50.8 | 38.5 | 43.5 | 55 | 43 |
| Tensile | 104.6 | 103.7 | 109.9 | 136.3 | 90.6 | 100 | 100 |
| % E | 50.8 | 53.5 | 52.5 | 36 | 56 | 45 | 56 |
| OCH | 0.43 | 0.45 | 0.44 | 0.31 | 0.45 | — | — |
| SSCVN | 56.3 | 53.3 | 57.7 | 68.0 | 70 | — | — |

Table 1 also includes a raw material cost index (RMCI), which compares the material costs for each alloy to that of Comparative Alloy S31600. The RMCI was calculated by multiplying the average October 2007 cost for the raw materials Fe, Cr, Mn, Ni, Mo, W, and Co by the percent of each element contained in the alloy and dividing by the cost of the raw materials in Comparative Alloy S31600. As the calculated values show, all of the Inventive Alloys have a RMCI of less than 0.6, which means the cost of the raw materials contained therein are less than 60% of those in Comparative Alloy S31600. That a material could be made that has similar properties to Comparative Alloy S31600 at a significantly lower raw material cost is surprising and was not anticipated from the prior art.

The mechanical properties of Inventive Alloys 1 and 3-11 were measured and compared to those of a Comparative Alloy, CA1, and commercially available Comparative Alloys S31600, S21600, and S20100. The measured yield strength, tensile strength, percent elongation over a 2-inch gage length, Olsen cup height and ½-size Charpy V-notch impact energy are shown in Table 1 for Inventive Alloys and 3-11. The tensile tests were conducted on 0.100" gage material, the Charpy tests were conducted on 0.197" thick samples, and the Olsen cup tests were run on material between 0.040- and 0.050-inch thick. All tests were performed at room temperature. Units for the data in Table 1 are as follows: yield strength and tensile strength, ksi; elongation, percent; Olsen cup height, inches; Charpy impact energy, ft-lbs. As can be seen from the data, the Inventive Alloys exhibited comparable properties to those of Comparative Alloy S31600.

Even though the composition of Comparative Alloy CA1 lies within the ranges of the Inventive Alloys, the balance of elements is such that the $MD_{30}$ and $PRE_W$ are outside of the claimed ranges. The mechanical test results show that CA1, is not as formable as S31600, and its low $PRE_W$ means that its resistance to pitting corrosion will not be as good as that of S31600.

Elevated temperature tensile tests were performed on Inventive Alloy 1 at 70, 600, 1000, and 1400° F. The results are shown in Table 2. The data illustrates that the performance of Inventive Alloy 1 is comparable to that of Comparative Alloy S31600 at elevated temperatures.

TABLE 2

| | Temperature (° F.) | Yield Strength (ksi) | Tensile Strength (ksi) | Percent Elongation |
|---|---|---|---|---|
| Inventive Alloy 1 | 70 | 49.1 | 108.7 | 68.0% |
| | 600 | 25.1 | 74.0 | 40.3% |
| | 1000 | 21.6 | 63.9 | 36.3% |
| | 1400 | 20.0 | 35.3 | 75.0% |
| S31600 | 70 | 43.9 | 88.2 | 56.8% |
| | 600 | 28.1 | 67.5 | 33.8% |
| | 1000 | 29.5 | 63.4 | 36.8% |
| | 1400 | 22.1 | 42.0 | 25.0% |

Table 3 illustrates the results of two stress-rupture tests performed on Inventive Alloy 1 at 1300° F. under a stress of 22 ksi. FIG. 1 demonstrates that the stress-rupture results for Inventive Alloy 1 are comparable to those properties obtained for Comparative Alloy S31600 (LMP is the Larsen-Miller Parameter, which combines time and temperature into a single variable).

TABLE 3

| T (° F.) | Stress (ksi) | Time (h) | LMP | Elongation |
|---|---|---|---|---|
| 1300 | 22.0 | 233.6 | 39369 | 72% |
| 1300 | 22.0 | 254.7 | 39435 | 79% |

The potential uses of these new alloys are numerous. As described and evidenced above, the austenitic stainless steel compositions described herein are capable of replacing S31600 in many applications. Additionally, due to the high cost of Ni and Mo, a significant cost savings will be recognized by switching from S31600 to the inventive alloy compositions. Another benefit is, because these alloys are fully austenitic, that they will not be susceptible to either a sharp ductile-to-brittle transition (DBT) at sub-zero temperature or 885° F. embrittlement. Therefore, unlike duplex alloys, they can be used at temperatures above 650° F. and are prime candidate materials for low temperature and cryogenic applications. It is expected that the corrosion resistance, formability, and processability of the alloys described herein will be very close to those of standard austenitic stainless steels. Non-limiting examples of articles of manufacture that may be fabricated from or include the present alloys are corrosion resistant articles, corrosion resistant architectural panels, flexible connectors, bellows, tube, pipe, chimney liners, flue liners, plate frame heat exchanger parts, condenser parts, parts for pharmaceutical processing equipment, part used in sanitary applications, and parts for ethanol production or processing equipment.

Although the foregoing description has necessarily presented only a limited number of embodiments, those of ordinary skill in the relevant art will appreciate that various changes in the apparatus and methods and other details of the examples that have been described and illustrated herein may be made by those skilled in the art, and all such modifications will remain within the principle and scope of the present disclosure as expressed herein and in the appended claims. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

What is claimed is:

1. An austenitic stainless steel consisting of, in % weight,
up to 0.20 C,
2.0-9.0 Mn,
up to 0.50 Si,
16.0-23.0 Cr,
1.0-3.0 Ni,
up to 3.0 Mo,
0.1-0.35 N,
0.05 to 4.0 W,
up to 0.01 B,
up to 1.0 Co,
iron and
impurities,
the steel having a ferrite number of at least 3 up to less than 10, and a $MD_{30}$ value less than 20° C.

2. The austenitic stainless steel according to claim 1, wherein:

$$0.5 \leq (Mo+W/2) \leq 5.0.$$

3. The austenitic stainless steel according to claim 1, having a $PRE_W$ value of greater than 22.

4. The austenitic stainless steel of claim 1, having a $PRE_W$ value greater than 22 and up to 30.

5. The austenitic stainless steel of claim 1, having a ferrite number of 3 up to 5.

6. The austenitic stainless steel of claim 1, having a $MD_{30}$ value less than −10° C.

7. The austenitic stainless steel of claim 1, wherein C is limited to up to 0.08.

8. The austenitic stainless steel of claim 1, wherein Si is limited to 0.2 to 0.50.

9. The austenitic stainless steel of claim 1, wherein Mn is limited to 2.0-8.0.

10. The austenitic stainless steel of claim 1, wherein Mn is limited to 3.0-6.0.

11. The austenitic stainless steel of claim 1, wherein Cr is limited to 16.0-22.0.

12. The austenitic stainless steel of claim 1, wherein Cr is limited to 17.0-21.0.

13. The austenitic stainless steel of claim 1, wherein Cr is limited to 17.0-20.0.

14. The austenitic stainless steel of claim 1, wherein Cr is limited to 16.0-18.0.

15. The austenitic stainless steel of claim 1, wherein N is limited to 0.1-0.30.

16. The austenitic stainless steel of claim 1, wherein N is limited to 0.14-0.30.

17. The austenitic stainless steel of claim 1, wherein Mo is limited to 0.40-3.0.

18. The austenitic stainless steel of claim 1, wherein Mo is limited to 0.5-2.0.

19. The austenitic stainless steel of claim 1, wherein B is limited to up to 0.008.

20. The austenitic stainless steel of claim 1, wherein W is limited to 0.05-0.60.

21. The austenitic stainless steel of claim 1, wherein Mo is limited to 0.40-2.0 and having a $MD_{30}$ value less than −10° C.

22. The austenitic stainless steel of claim 1, wherein Mo is limited to 0.40-2.0 and wherein $0.5 \leq (Mo+W/2) \leq 4.0$.

23. The austenitic stainless steel of claim 19, having a $MD_{30}$ value less than −10° C.

24. The austenitic stainless steel according to claim 1, consisting of, in % weight,
up to 0.10 C,
2.0-8.0 Mn,
up to 0.50 Si,
16.0-22.0 Cr,
1.0-3.0 Ni,
0.40-2.0 Mo,
0.12-0.30 N,
0.050-0.60 W,
up to 1.0 Co,
up to 0.008 B,
iron and
impurities comprising up to 0.04 P and up to 0.03 S,
the steel having a ferrite number of at least 3 up to less than 10 and a $MD_{30}$ value less than 20° C.

25. The austenitic stainless steel of claim 24, having a $MD_{30}$ value less than −10° C.

26. The austenitic stainless steel of claim 24, having a $PRE_W$ value greater than 22 up to 30.

27. The austenitic stainless steel according to claim 1, consisting of, in % weight,
up to 0.08 C,
3.0-6.0 Mn,
up to 0.5 Si,
17.0-21.0 Cr,
1.0-3.0 Ni,
0.50-2.0 Mo,
0.14-0.30 N,
up to 1.0 Co,
0.05-0.60 W,
iron and
impurities comprising up to 0.05 P and up to 0.03 S,
the steel having a ferrite number of at least 3 up to less than 10 and a $MD_{30}$ value of less than 20° C.

28. The austenitic stainless steel of claim 27 having a $MD_{30}$ value less than −10° C.

29. The austenitic stainless steel of claim 27, having a $PRE_W$ value greater than 22 and up to 30.

30. An austenitic stainless steel consisting of, in % weight,
up to 0.20 C,
2.0-9.0 Mn,
up to 0.50 Si, 16.0-23.0 Cr,
1.0-3.0 Ni,
0.40-3.0 Mo,
0.1-0.30 N,
0.05 to 4.0 W,
up to 0.01 B,
up to 1.0 Co,
iron and
impurities, the steel having a ferrite number at least 3 up to 10, a $PRE_W$ value greater than 22 up to 30, and a $MD_{30}$ value of less than 20° C.

31. The austenitic stainless steel of claim 30, wherein Mo is limited to 0.40-2.0 and wherein $0.5 \leq (Mo+W/2) \leq 4.0$.

32. The austenitic stainless steel of claim 30, wherein the Si is limited to 0.2-0.5 and Mn is limited to 6.0-9.0.

33. An article of manufacture including an austenitic stainless steel consisting of, in % weight, up to 0.20 C,
2.0-9.0 Mn,
up to 0.50 Si,
16.0-23.0 Cr,
1.0-3.0 Ni,
up to 3.0 Mo,
0.1-0.35 N,
0.05 to 4.0 W,
up to 0.01 B,
up to 1.0 Co,
iron and
impurities, the steel having a ferrite number of at least 3 up to less than 10, and a $MD_{30}$ value less than 20° C.

34. The article of manufacture of claim 33, wherein the austenitic stainless steel has a $MD_{30}$ value less than −10° C.

35. The article of manufacture of claim 33, wherein in the austenitic stainless steel Mo is limited to 0.40-2.0 Mo.

36. The article of manufacture of claim 33, wherein the article is adapted for use in at least one of a low temperature environment and a cryogenic environment.

37. The article of manufacture of claim 33, wherein the article is selected from the group consisting of a corrosion resistant article, a corrosion resistant architectural panel, a flexible connector, a bellows, a tube, a pipe, a chimney liner, a flue liner, a plate frame heat exchanger part, a condenser part, a part for pharmaceutical processing equipment, a sanitary part, and a part for ethanol production or processing equipment.

38. The article of manufacture of claim 34 including an austenitic stainless steel consisting of, in % weight, up to 0.20 C,
2.0-9.0 Mn,
up to 0.50 Si,
16.0-23.0 Cr,
1.0-3.0 Ni,
0.40-3.0 Mo,
0.1-0.30 N,
0.05 to 4.0 W,
up to 0.01 B,
up to 1.0 Co,
iron and
impurities, the steel having a ferrite number at least 3 up to 10, a $PRE_W$ value greater than 22 up to 30, and a $MD_{30}$ value of less than 20° C.

* * * * *